US009019198B2

(12) United States Patent
Lin et al.

(10) Patent No.: US 9,019,198 B2
(45) Date of Patent: Apr. 28, 2015

(54) DRIVING METHOD OF PASSIVE DISPLAY PANEL AND DISPLAY APPARATUS

(71) Applicant: SiPix Technology Inc., Taoyuan County (TW)

(72) Inventors: Feng-Shou Lin, Tainan (TW); Wen-Pin Chiu, Taoyuan County (TW); Chen-Hai Tsai, Taoyuan County (TW); Chun-An Wei, New Taipei (TW)

(73) Assignee: SiPix Technology Inc., Taoyuan (TW)

( * ) Notice: Subject to any disclaimer, the term of this patent is extended or adjusted under 35 U.S.C. 154(b) by 206 days.

(21) Appl. No.: 13/632,168

(22) Filed: Oct. 1, 2012

(65) Prior Publication Data

US 2014/0009516 A1 Jan. 9, 2014

(30) Foreign Application Priority Data

Jul. 5, 2012 (TW) ..... 101124255 A

(51) Int. Cl.
*G09G 3/34* (2006.01)
*G09G 3/20* (2006.01)

(52) U.S. Cl.
CPC ..... *G09G 3/2085* (2013.01); *G09G 2300/06* (2013.01); *G09G 2380/14* (2013.01)

(58) Field of Classification Search
CPC . G09G 3/344; G09G 3/3433; G09G 2300/06; G09G 2310/02
USPC ..... 345/107, 55
See application file for complete search history.

(56) References Cited

U.S. PATENT DOCUMENTS

2011/0317252 A1* 12/2011 Wang et al. ..... 359/296
2012/0062611 A1* 3/2012 Wang et al. ..... 345/690

FOREIGN PATENT DOCUMENTS

| | | |
|---|---|---|
| TW | 201015508 | 4/2010 |
| TW | 201211973 | 3/2012 |
| TW | 201216241 | 4/2012 |
| WO | 2008033876 | 3/2008 |

OTHER PUBLICATIONS

"Office Action of Taiwan Counterpart Application", issued on Aug. 12, 2014, p. 1-p. 7, in which the listed references were cited.

* cited by examiner

*Primary Examiner* — Jonathan Horner
(74) *Attorney, Agent, or Firm* — Jianq Chyun IP Office

(57) ABSTRACT

A driving method of a passive displayed panel and a display apparatus are provided. The passive display panel includes a plurality of pixels arranged into an array. The driving method includes following steps. Whether to display a first color frame or a second color frame on the passive display panel is determined according to a display frame. Whether to display a first color at each row or each column of the pixels of the passive display panel is determined according to the display frame. Whether to display a second color at each row or each column of the pixels of the passive display panel is determined according to the display frame. The first color or the second color is displayed column by column or row by row on the passive display panel at those portions of the display frame that do not display the first color or the second color.

25 Claims, 9 Drawing Sheets

400

DRIVING METHOD OF PASSIVE DISPLAY PANEL AND DISPLAY APPARATUS

CROSS-REFERENCE TO RELATED APPLICATION

This application claims the priority benefit of Taiwan application serial no. 101124255, filed on Jul. 5, 2012. The entirety of the above-mentioned patent application is hereby incorporated by reference herein and made a part of this specification.

BACKGROUND OF THE INVENTION

1. Field of the Invention

The invention generally relates to a driving method of a display panel, and more particularly, to a driving method of a passive display panel and a display apparatus.

2. Description of Related Art

In recent years, flat panel display has been broadly applied thanks to it many advantages such as high space efficiency, high image quality, low power consumption, and no radiation. Generally, each pixel in a flat panel display is considered an independent capacitor, and charges for displaying a gray scale or a color are stored in each capacitor. The display panels of Flat panel displays can be categorized into active matrix display panels and passive matrix display panels. An active device (for example, a thin film transistor (TFT)) is disposed in each pixel of an active matrix display panel. Whether the pixel is driven to display a corresponding gray scale (or color) is determined by the on/off of the active device, and the pixel continues to display the corresponding gray scale (or color) until next time the active device is turned on. Contrarily, no active device is disposed in each pixel of a passive matrix display, and the pixel is directly driven by a voltage thereon.

Conventionally, the pixels of a passive matrix display are driven through a single-point driving method. Namely, the pixels in the display panel are driven one by one so that the capacitor of each pixel stores a corresponding number of charges and accordingly displays a corresponding gray scale (or color). However, because the pixels in a display panel share the column electrodes and the row electrodes, when a single pixel is driven through the single-point driving method, charges stored in other pixels of the passive matrix display are affected due to the capacitive coupling effect, and accordingly the gray scales (or colors) displayed by other pixels of the passive matrix display are affected. In addition, the conventional single-point driving method drives the pixels of a display panel one by one therefore offers a very long driving time.

SUMMARY OF THE INVENTION

Accordingly, the invention is directed to a driving method of a passive display panel and a display apparatus, in which the impact of capacitive coupling effect on the display quality of the pixels is avoided or reduced, and the driving time for displaying a single frame on the passive display panel is shortened.

The invention provides a driving method of a passive display panel. The passive display panel includes a plurality of pixels arranged into an array. The driving method includes following steps. Whether to display a first color frame or a second color frame on the passive display panel is determined according to a display frame. After the second color frame is displayed on the passive display panel, whether to display a first color at each row of the pixels of the passive display panel is determined according to the display frame, and whether to display the first color at each column of the pixels of the passive display panel is determined according to the display frame. After the first color frame is displayed on the passive display panel, whether to display a second color at each row of the pixels of the passive display panel is determined according to the display frame, and whether to display the second color at each column of the pixels of the passive display panel is determined according to the display frame. The first color is displayed row by row or column by column at the pixels of the passive display panel that are corresponding to the first color and do not display the first color, and the second color is displayed row by row or column by column at the pixels of the passive display panel that are corresponding to the second color and do not display the second color.

According to an embodiment of the invention, the step of determining whether to display the first color frame or the second color frame on the passive display panel according to the display frame further includes following steps. A first pixel number corresponding to the first color and a second pixel number corresponding to the second color in the display frame are calculated. When the first pixel number is greater than or equal to the second pixel number, the first color frame is displayed on the passive display panel, and when the first pixel number is smaller than the second pixel number, the second color frame is displayed on the passive display panel.

According to an embodiment of the invention, the step of determining whether to display the first color at each row of the pixels of the passive display panel according to the display frame further includes following steps. A plurality of third pixel numbers respectively corresponding to the first color in a plurality of rows of display data of the display frame is calculated, and when each of the third pixel numbers is greater than or equal to a row threshold, the first color is displayed at corresponding rows of the pixels of the passive display panel.

According to an embodiment of the invention, the step of determining whether to display the second color at each row of the pixels of the passive display panel according to the display frame further includes following steps. A plurality of fourth pixel numbers respectively corresponding to the second color in a plurality of rows of display data of the display frame is calculated, and when each of the fourth pixel numbers is greater than or equal to the row threshold, the second color is displayed at corresponding rows of the pixels of the passive display panel.

According to an embodiment of the invention, the step of determining whether to display the first color at each column of the pixels of the passive display panel according to the display frame further includes following steps. A plurality of fifth pixel numbers respectively corresponding to the first color in a plurality of columns of display data of the display frame is calculated, and when each of the fifth pixel numbers is greater than or equal to a column threshold, the first color is displayed at corresponding columns of the pixels of the passive display panel.

According to an embodiment of the invention, the step of determining whether to display the second color at each column of the pixels of the passive display panel according to the display frame further includes following steps. A plurality of sixth pixel numbers respectively corresponding to the second color in a plurality of columns of display data of the display frame is calculated, and when each of the sixth pixel numbers is greater than or equal to the column threshold, the second color is displayed at corresponding columns of the pixels of the passive display panel.

According to an embodiment of the invention, the step of displaying the first color row by row or column by column at the pixels of the passive display panel that are corresponding to the first color and do not display the first color further includes following steps. When a column number of the passive display panel is greater than a row number of the passive display panel, the first color is displayed column by column at the pixels of the passive display panel that are corresponding to the first color and do not display the first color. When the column number of the passive display panel is smaller than the row number of the passive display panel, the first color is displayed row by row at the pixels of the passive display panel that are corresponding to the first color and do not display the first color. When the column number of the passive display panel is equal to the row number of the passive display panel, the first color is displayed column by column or row by row at the pixels of the passive display panel that are corresponding to the first color and do not display the first color.

According to an embodiment of the invention, the step of displaying the second color column by column or row by row at the pixels of the passive display panel that are corresponding to the second color and do not display the second color further includes following steps. When the column number of the passive display panel is greater than the row number of the passive display panel, the second color is displayed column by column at the pixels of the passive display panel that are corresponding to the second color and do not display the second color. When the column number of the passive display panel is smaller than the row number of the passive display panel, the second color is displayed row by row at the pixels of the passive display panel that are corresponding to the second color and do not display the second color. When the column number of the passive display panel is equal to the row number of the passive display panel, the second color is displayed column by column or row by row at the pixels of the passive display panel that are corresponding to the second color and do not display the second color.

According to an embodiment of the invention, the step of determining whether to display the first color at each row of the pixels of the passive display panel according to the display frame and determining whether to display the first color at each column of the pixels of the passive display panel according to the display frame further includes following steps. A plurality of column pixel numbers respectively corresponding to the first color in a plurality of columns of display data of the display frame is calculated. The number of column pixel numbers that are greater than or equal to the column threshold is calculated as a column weight. A plurality of row pixel numbers respectively corresponding to the first color in a plurality of rows of display data of the display frame is calculated. The number of row pixel numbers that are greater than or equal to the row threshold is calculated as a row weight. When the column weight is greater than the row weight and each of the column pixel numbers is greater than or equal to the column threshold, the first color is displayed at corresponding columns of the pixels of the passive display panel. When the column weight is smaller than or equal to the row weight and each of the row pixel numbers is greater than or equal to the row threshold, the first color is displayed at corresponding rows of the pixels of the passive display panel.

According to an embodiment of the invention, the step of determining whether to display the second color at each row of the pixels of the passive display panel according to the display frame and determining whether to display the second color at each column of the pixels of the passive display panel according to the display frame further includes following steps. A plurality of column pixel numbers respectively corresponding to the second color in a plurality of columns of display data of the display frame is calculated. The number of column pixel numbers that are greater than or equal to the column threshold is calculated as a column weight. A plurality of row pixel numbers respectively corresponding to the second color in a plurality of rows of display data of the display frame is calculated. The number of row pixel numbers that are greater than or equal to the row threshold is calculated as a row weight. When the column weight is greater than the row weight and each of the column pixel numbers is greater than or equal to the column threshold, the second color is displayed at corresponding columns of the pixels of the passive display panel. When the column weight is smaller than or equal to the row weight and each of the row pixel numbers is greater than or equal to the row threshold, the second color is displayed at corresponding rows of the pixels of the passive display panel.

The invention provides a display apparatus including a passive display panel and a driving circuit. The passive display panel includes a plurality of pixels arranged into an array. The driving circuit is coupled to the passive display panel. The driving circuit determines whether to display a first color frame or a second color frame on the passive display panel according to a display frame. After displaying the second color frame on the passive display panel, the driving circuit determines whether to display a first color at each row of the pixels of the passive display panel according to the display frame and determines whether to display the first color at each column of the pixels of the passive display panel according to the display frame. After displaying the first color frame on the passive display panel, the driving circuit determines whether to display a second color at each row of the pixels of the passive display panel according to the display frame and determines whether to display the second color at each column of the pixels of the passive display panel according to the display frame. The driving circuit displays the first color column by column or row by row at the pixels of the passive display panel that are corresponding to the first color and do not display the first color, and the driving circuit displays the second color column by column or row by row at the pixels of the passive display panel that are corresponding to the second color and do not display the second color.

According to an embodiment of the invention, the driving circuit calculates a first pixel number corresponding to the first color and a second pixel number corresponding to the second color in the display frame. When the first pixel number is greater than or equal to the second pixel number, the driving circuit displays the first color frame on the passive display panel, and when the first pixel number is smaller than the second pixel number, the driving circuit displays the second color frame on the passive display panel.

According to an embodiment of the invention, the driving circuit calculates a plurality of third pixel numbers respectively corresponding to the first color in a plurality of rows of display data of the display frame. When each of the third pixel numbers is greater than or equal to a row threshold, the driving circuit displays the first color at corresponding rows of the pixels of the passive display panel.

According to an embodiment of the invention, the driving circuit calculates a plurality of fourth pixel numbers respectively corresponding to the second color in a plurality of rows of display data of the display frame. When each of the fourth pixel numbers is greater than or equal to the row threshold, the driving circuit displays the second color at corresponding rows of the pixels of the passive display panel.

According to an embodiment of the invention, the row threshold is greater than or equal to half of a column number of the passive display panel.

According to an embodiment of the invention, the driving circuit calculates a plurality of fifth pixel numbers respectively corresponding to the first color in a plurality of columns of display data of the display frame. When each of the fifth pixel numbers is greater than or equal to a column threshold, the driving circuit displays the first color at corresponding columns of the pixels of the passive display panel.

According to an embodiment of the invention, the driving circuit calculates a plurality of sixth pixel numbers respectively corresponding to the second color in a plurality of columns of display data of the display frame. When each of the sixth pixel numbers is greater than or equal to the column threshold, the driving circuit displays the second color at corresponding columns of the pixels of the passive display panel.

According to an embodiment of the invention, the column threshold is greater than or equal to half of a row number of the passive display panel.

According to an embodiment of the invention, when the column number of the passive display panel is greater than the row number of the passive display panel, the driving circuit displays the first color column by column at the pixels of the passive display panel that are corresponding to the first color and do not display the first color. When the column number of the passive display panel is smaller than the row number of the passive display panel, the driving circuit displays the first color row by row at the pixels of the passive display panel that are corresponding to the first color and do not display the first color. When the column number of the passive display panel is equal to the row number of the passive display panel, the driving circuit displays the first color column by column or row by row at the pixels of the passive display panel that are corresponding to the first color and do not display the first color.

According to an embodiment of the invention, when the column number of the passive display panel is greater than the row number of the passive display panel, the driving circuit displays the second color column by column at the pixels of the passive display panel that are corresponding to the second color and do not display the second color. When the column number of the passive display panel is smaller than the row number of the passive display panel, the driving circuit displays the second color row by row at the pixels of the passive display panel that are corresponding to the second color and do not display the second color. When the column number of the passive display panel is equal to the row number of the passive display panel, the driving circuit displays the second color column by column or row by row at the pixels of the passive display panel that are corresponding to the second color and do not display the second color.

According to an embodiment of the invention, the first color and the second color are respectively white and black.

According to an embodiment of the invention, the passive display panel is an electronic paper display panel.

According to an embodiment of the invention, the driving circuit calculates a plurality of column pixel numbers respectively corresponding to the first color in a plurality of columns of display data of the display frame, and the driving circuit calculates the number of column pixel numbers that are greater than or equal to the column threshold and serves the number as a column weight. The driving circuit calculates a plurality of row pixel numbers respectively corresponding to the first color in a plurality of rows of display data of the display frame, and the driving circuit calculates the number of row pixel numbers that are greater than or equal to the row threshold and serves the number as a row weight. When the column weight is greater than the row weight and each of the column pixel numbers is greater than or equal to the column threshold, the driving circuit displays the first color at corresponding columns of the pixels of the passive display panel. When the column weight is smaller than or equal to the row weight and each of the row pixel numbers is greater than or equal to the row threshold, the driving circuit displays the first color at corresponding rows of the pixels of the passive display panel.

According to an embodiment of the invention, the driving circuit calculates a plurality of column pixel numbers respectively corresponding to the second color in a plurality of columns of display data of the display frame, and the driving circuit calculates the number of column pixel numbers that are greater than or equal to the column threshold and serves the number as a column weight. The driving circuit calculates a plurality of row pixel numbers respectively corresponding to the second color in a plurality of rows of display data of the display frame, and the driving circuit calculates the number of row pixel numbers that are greater than or equal to the row threshold and serves the number as a row weight. When the column weight is greater than the row weight and each of the column pixel numbers is greater than or equal to the column threshold, the driving circuit displays the second color at corresponding columns of the pixels of the passive display panel. When the column weight is smaller than or equal to the row weight and each of the row pixel numbers is greater than or equal to the row threshold, the driving circuit displays the second color at corresponding rows of the pixels of the passive display panel.

As described above, the invention provides a driving method of a passive display panel and a display apparatus, in which a first color or a second color is displayed at each column or each row of the pixels of the passive display panel, and the first color or the second color is displayed column by column or row by row at the pixels that are corresponding to the first or the second color but do not display the same, so that the impact of capacitive coupling effect on the display quality of the pixels can be avoided or reduced, and the driving time for displaying a single frame on the passive display panel can be shortened.

These and other exemplary embodiments, features, aspects, and advantages of the invention will be described and become more apparent from the detailed description of exemplary embodiments when read in conjunction with accompanying drawings.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1A:
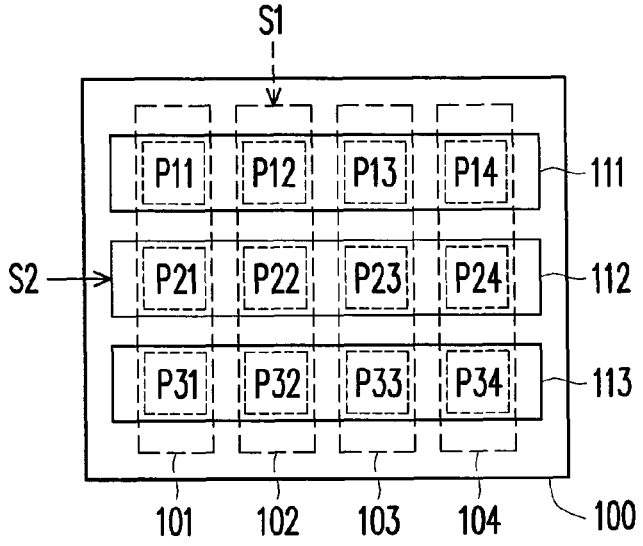
FIG. 1A is a diagram illustrating the pixel layout of a passive display panel.

Reference will now be made in detail to the present preferred embodiments of the invention, examples of which are illustrated in the accompanying drawings. Wherever possible, the same reference numbers are used in the drawings and the description to refer to the same or like parts.

Figure 1B:
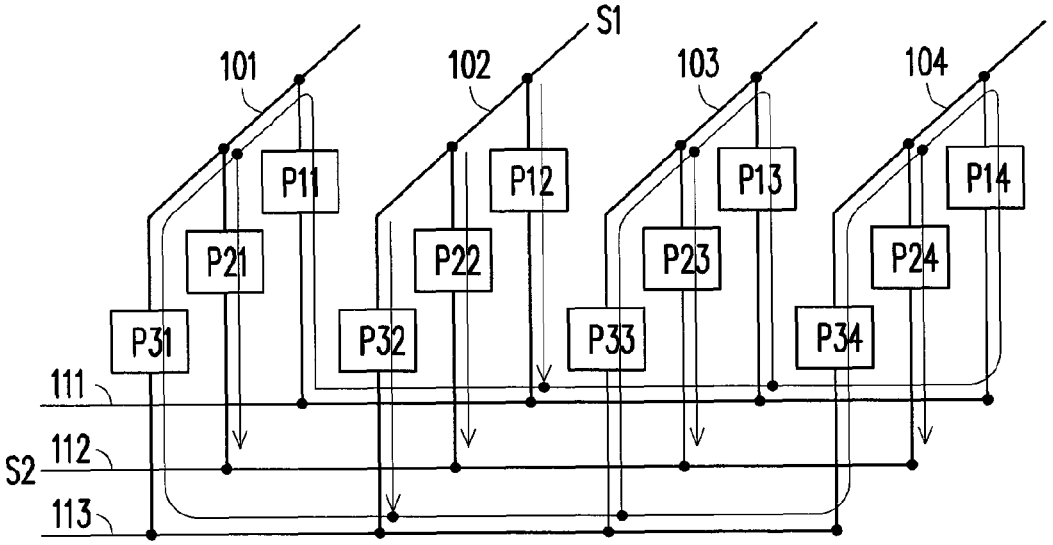
FIG. 1B is an equivalent circuit diagram of the passive display panel in FIG. 1A.
Figure 2A:
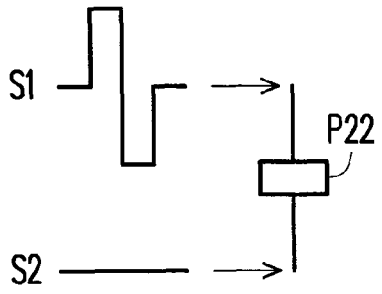
FIGS. 2A-2D are diagrams illustrating the capacitive coupling effect on pixels P11-P14, P21-P24, and P31-P34 of the passive display panel in FIG. 1A.
Figure 2B:
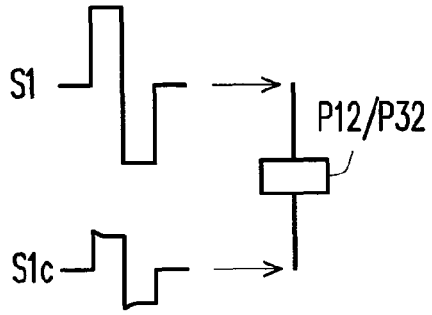
Figure 2C:
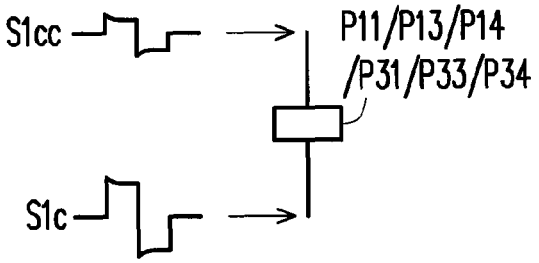
Figure 2D:
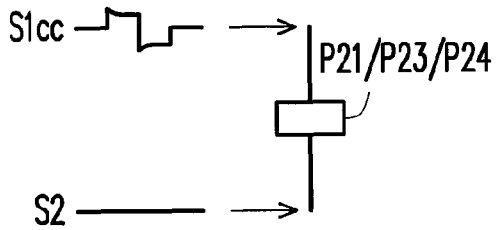

FIG. 1A is a diagram illustrating the pixel layout of a passive display panel. FIG. 1B is an equivalent circuit diagram of the passive display panel in FIG. 1A. Referring to FIG. 1A, the passive display panel 100 has 4 column electrodes 101-104 and 3 row electrodes 111-113. The pixels (for example, the pixels P11-P14, P21-P24, and P31-P34) of the passive display panel 100 are located at the intersections of the column electrodes 101-104 and the row electrodes 111-113 (i.e., the pixels P11-P14, P21-P24, and P31-P34 are arranged into an array). Referring to FIG. 1A and FIG. 1B, assuming that the pixel P22 is driven, a driving signal S1 is input to the column electrode 102, and a driving signal S2 is input to the row electrode 112. Besides, the column electrodes 101, 103, and 104 and the row electrodes 111 and 113 are floating (i.e., no voltage is supplied to the column electrodes 101, 103, and 104 or the row electrodes 111 and 113). However, the column electrodes 101, 103, and 104 or the row electrodes 111 and 113 may still produce coupling voltages because of the capacitive coupling effect. Thus, the undriven pixels P11-P14, P21, P23, P24, and P31-P34 may be affected by the coupling voltages to produce unexpected display.

FIGS. 2A-2D are diagrams illustrating the capacitive coupling effect on pixels P11-P14, P21-P24, and P31-P34 of the passive display panel in FIG. 1A. Referring to FIG. 1A, FIG. 1B, and FIGS. 2A-2D, herein it is assumed that the driving signal S1 input to the column electrode 102 is an AC signal (i.e., composed of positive pulses and negative pulses), and the driving signal S2 input to the row electrode 112 is a DC voltage. The driving signal S1 is transmitted to the pixel P22 via the column electrode 102, and the driving signal S2 is transmitted to the pixel P22 via the row electrode 112. Besides, the driving signal S1 is also transmitted to the pixels P12 and P32 via the column electrode 102. Since the pixels P12 and P32 are respectively considered a capacitor, coupling voltage signals S1*c* are generated through the capacitive coupling effect of the pixels P12 and P32. Herein the coupling voltage signals S1*c* are respectively output to the floating row electrodes 111 and 113. Next, the coupling voltage signal S1*c* is transmitted to the pixels P11, P13, P14, P31, P33, and P34 via the row electrodes 111 and 113, and coupling voltage signals S1*cc* are generated through the capacitive coupling effect of the pixels P11, P13, P31, and P33. Herein the coupling voltage signals S1*cc* are respectively output to the floating column electrodes 101, 103, and 104. Eventually, the coupling voltage signals S1*cc* is transmitted to the pixels P21, P23, and P24 via the column electrodes 101, 103, and 104, and the driving signal S2 is transmitted to the pixels P21, P23, and P24 via the row electrode 112.

Thereby, when the conventional single-point driving method is adopted, coupling voltage signals (for example, the coupling voltage signals S1*c* and S1*cc*) pass through the floating column electrodes (for example, the column electrodes 101, 103, and 104) and row electrodes (for example, the row electrodes 111 and 113) under the capacitive coupling effect, and those undriven pixels (for example, the pixels P11-P14, P21, P23, P24, and P31-P34) are affected by the coupling voltage signal (for example, the coupling voltage signals S1*c* and S1*cc*) to produce misoperations. As a result, the gray scales (or colors) displayed by the pixels may be different from the expected gray scales (or colors) and accordingly the display quality of the passive display panel 100 may be reduced.

Referring to FIG. 1B, it is assumed that the coupling voltage of the column electrode 101 is V101, the coupling voltage of the column electrode 103 is V103, the coupling voltage of the column electrode 104 is V104, the coupling voltage of the row electrodes 111 is V111, the coupling voltage of the row electrodes 113 is V113, and the equivalent resistance of the pixels P11-P14, P21-P24, and P31-P34 is Rp. According to the Kirchhoff circuit laws, the current passing through the pixel P12 is the total of the currents passing through the pixels P11, P13, and P14, and the current passing through the pixel P32 is the total of the currents passing through the pixels P31, P33, and P34. The formulae are as shown below:

$$(V1-V111)/Rp=[3*V111-(V101+V103+V104)]/Rp \quad (1.1)$$

$$(V1-V113)/Rp=[3*V113-(V101+V103+V104)]/Rp \quad (1.2)$$

Herein V1 is the voltage level of the driving signal S1. Besides, following expressions can be obtained by transposing foregoing expressions 1.1 and 1.2:

$$V1=4*V111-(V101+V103+V104) \quad (2.1)$$

$$V1=4*V113-(V101+V103+V104) \quad (2.2)$$

As indicated by the expressions 2.1 and 2.2, the coupling voltage V111 is equal to the coupling voltage V113. Similarly, the coupling voltages V101, V103, and V104 are equal. Thus, by expressing the coupling voltages V111 and V113 with a voltage V3 and expressing the coupling voltages V101, V103, and V104 with a voltage V4, foregoing expressions 1.1 and 1.2 can be changed to:

$$V1-V3=3(V3-V4) \quad (3.1)$$

$$V4-V2=2(V3-V4) \quad (3.2)$$

Herein V2 is the voltage level of the driving signal S2. If the passive display panel 100 is extended to have N columns and M rows, foregoing expressions 3.1 and 3.2 become:

$$V1-V3=(N-1)(V3-V4) \quad (4.1)$$

$$V4-V2=(M-1)(V3-V4) \quad (4.2)$$

Following expressions related to the voltages V3 and V4 are obtained by transposing foregoing expressions 4.1 and 4.2:

$$V3=[M\times V1+(N-1)V2]/(M+N-1) \quad (5.1)$$

$$V4=[(M-1)V1+N\times V2]/(M+N-1) \quad (5.2)$$

Because the coupling voltages V111 and V113 are equal and the coupling voltages V101, V103, and V104 are equal, those pixels (for example, the pixels P21, P23, and P24) that share a row electrode (for example, the row electrode 112) with the driven pixel (for example, the pixel P22) have the same voltage, those pixels (for example, the pixels P12 and P32) share a column electrode (for example, the column electrode 102) with the driven pixel (for example, the pixel P22) have the same voltage, and the rest pixels (for example, the pixels P11, P13, P14, P31, P33, and P34) have the same voltage. Next, the voltage (denoted as ΔV1) of the pixels (for example, the pixels P21, P23, and P24) sharing the row electrode (for example, the row electrode 112) with the driven pixel (for example, the pixel P22), the voltage (denoted as ΔV2) of the pixels (for example, the pixels P12 and P32) sharing the column electrode (for example, the column electrode 102) with the driven pixel (for example, the pixel P22), and the voltage (denoted as ΔV3) of the rest pixels (for example, the pixels P11, P13, P14, P31, P33, and P34) can be obtained through foregoing expressions 5.1 and 5.2. The voltages ΔV1, ΔV2, and ΔV3 can be expressed as:

$$\Delta V1=V4-V2=(M-1)(V1-V2)/(M+N-1) \quad (6.1)$$

$$\Delta V2=V1-V3=(N-1)(V1-V2)/(M+N-1) \quad (6.2)$$

$$\Delta V3=V4-V3=(V2-V1)/(M+N-1) \quad (6.3)$$

It can be understood based on foregoing expressions 6.1, 6.2, and 6.3 that when a pixel (for example, the pixel P22) is driven through the single-point driving technique, the voltages of those undriven pixels (for example, the pixels P11-P14, P21, P23, P24, and P31-P34) are classified into three voltages (i.e., the voltages ΔV1, ΔV2, and ΔV3) according to the coupling relationship between the positions of the pixels and the driven pixel.

Figure 3A:
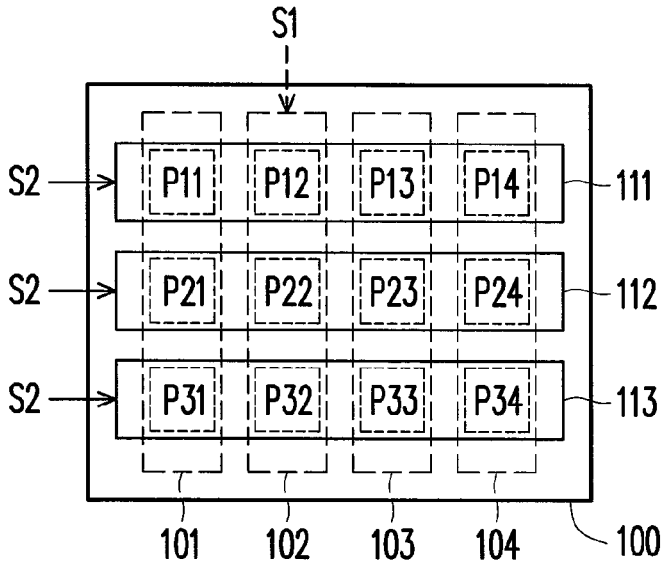
FIG. 3A and FIG. 3B are diagrams illustrating how an entire column of pixels of a passive display panel is driven.
Figure 3B:
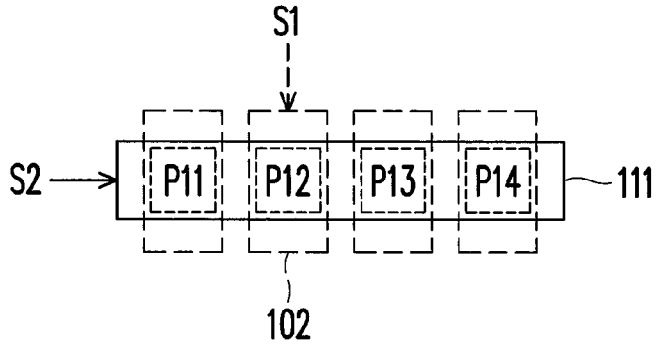

FIG. 3A and FIG. 3B are diagrams illustrating how an entire column of pixels of a passive display panel is driven. Referring to FIG. 3A and FIG. 3B, when the passive display panel 100 is driven in unit of each entire column of pixels (herein the driving of the pixels P12, P22, and P32 is taken as an example), it is considered as driving by a single-row (as shown in FIG. 3B), and the row number M in the expression 6.1 is considered 1. As indicated by foregoing expression 6.1, when row number M=1, the voltage ΔV1 of the undriven pixels (for example, the pixels P11, P13, P14, P21, P23, P24, P31, P33, and P34) is 0. Namely, no coupling voltage is produced and accordingly the display effect of the undriven pixels (for example, the pixels P11, P13, P14, P21, P23, P24, P31, P33, and P34) won't be affected by any coupling voltage. Similarly, when the passive display panel 100 is driven in unit of each entire row of pixels, the column number N in expression 6.2 is considered 1 and accordingly the voltage ΔV2 of the undriven pixels is 0.

Figure 4:
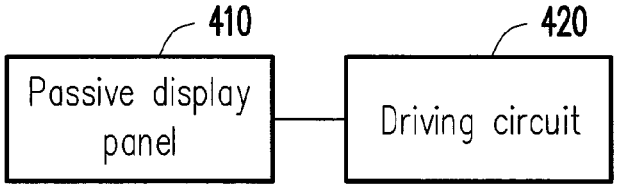
FIG. 4 is a system diagram of a display apparatus according to an embodiment of the invention.

FIG. 4 is a system diagram of a display apparatus according to an embodiment of the invention. Referring to FIG. 4, in the present embodiment, the display apparatus 400 includes a passive display panel 410 and a driving circuit 420. Any feature of the passive display panel 410 can be referred to descriptions related to the passive display panel 100. Namely, the passive display panel 410 has a plurality of column electrodes, a plurality of row electrodes, and a plurality of pixels. Besides, these pixels are arranged in to an array, and each of the pixels is respectively coupled to the corresponding column electrode and row electrode.

The driving circuit 420 is coupled to the passive display panel 410, and which drives the pixels of the passive display panel 410 to display corresponding images. Herein the driving circuit 420 first drives the passive display panel 410 to display a unicolor frame and then drives the passive display panel 410 to display each entire row or each entire column. Eventually, the driving circuit 420 drives the pixels of the passive display panel 410 through the single-point driving technique to adjust the image displayed on the passive display panel 410, so as to avoid or reduce the capacitive coupling effect and increase the image display rate (which will be explained in detail later on along with the driving method).

Figure 5:
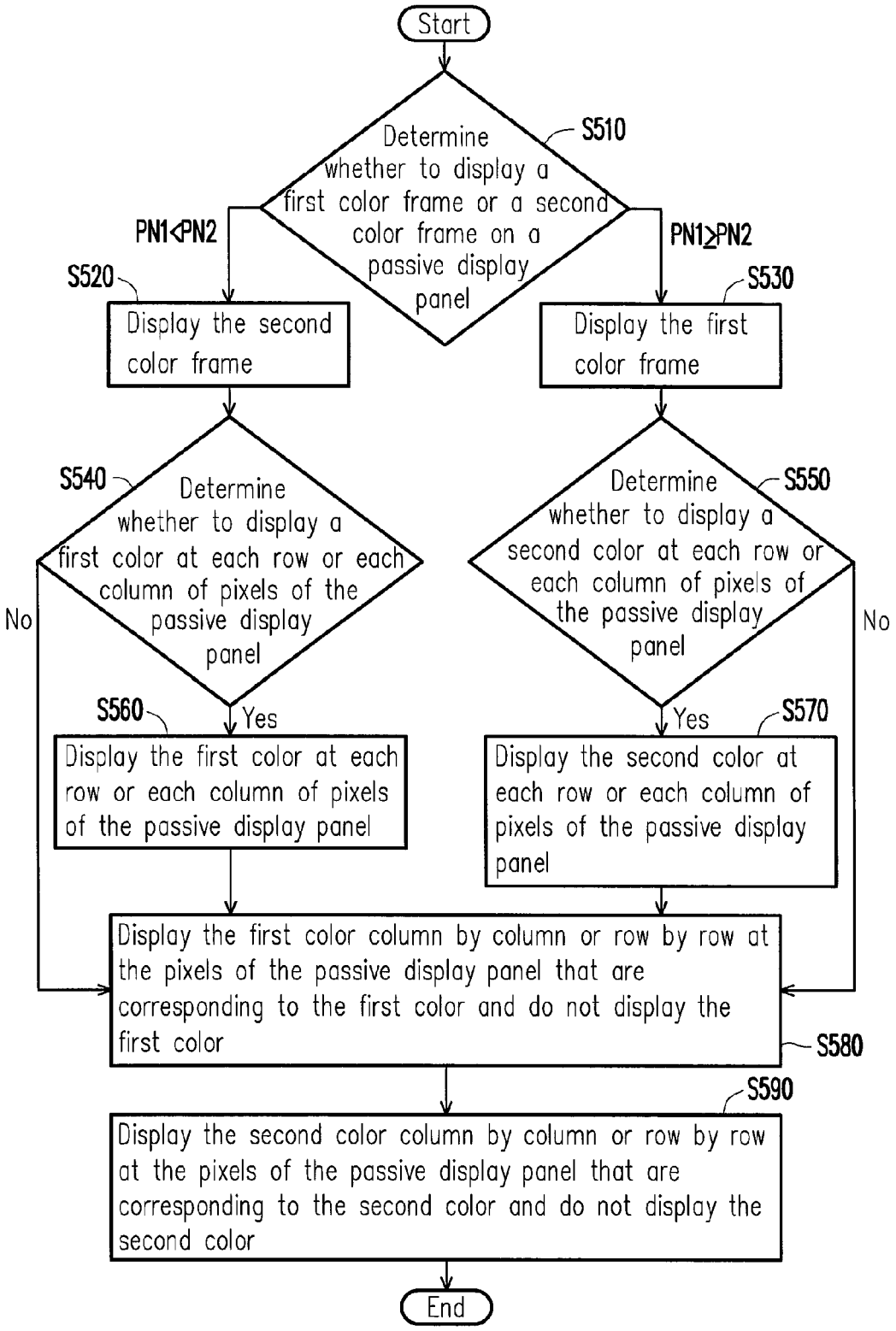
FIG. 5 is a flowchart of a driving method of a passive display panel according to an embodiment of the invention.

FIG. 5 is a flowchart of a driving method of a passive display panel according to an embodiment of the invention. Referring to FIG. 4 and FIG. 5, in step S510 of the present embodiment, the driving circuit 420 determines whether to display a first color frame or a second color frame on the passive display panel 410 according to a display frame to be displayed. Herein the first color frame and the second color frame are unicolor frames of different colors, and the colors presented by the first color frame and the second color frame are contrasting colors, such as black and white. For example, if the first color frame is a black frame, the second color frame is a white frame, and if the first color frame is a white frame, the second color frame is a black frame.

Herein, the driving circuit 420 calculates a pixel number PN1 (corresponding to a first pixel number) corresponding to a first color in the display frame and a pixel number PN2 (corresponding to a second pixel number) corresponding to a second color in the display frame and compares the pixel numbers PN1 and PN2. If the pixel number PN1 is smaller than the pixel number PN2, the driving circuit 420 executes step S520 to display the second color frame on the passive display panel 410. Step S540 is executed after step S520.

In step S540, the driving circuit 420 determines whether to display the first color at each row of pixels of the passive display panel 410 according to the display frame and determines whether to display the first color at each column of pixels of the passive display panel 410 according to the display frame. In an embodiment of the invention, the driving circuit 420 calculates a plurality of pixel numbers PN3 (corresponding to third pixel numbers and row pixel numbers) respectively corresponding to the first color in a plurality of rows of display data of the display frame (i.e., counts the number of pixels corresponding to the first color in each row of display data). Besides, the driving circuit 420 calculates a plurality of pixel numbers PN4 (corresponding to fifth pixel numbers and column pixel numbers) respectively corresponding to the first color in a plurality of columns of display data of the display frame (i.e., counts the number of pixels corresponding to the first color in each column of display data).

When at least one of the pixel numbers PN3 is greater than or equal to a row threshold or at least one of the pixel numbers PN4 is greater than or equal to a column threshold (i.e., the determination result of the step S540 is "Yes"), the driving circuit 420 executes step S560. Contrarily, when all the pixel numbers PN3 are smaller than the row threshold and all the pixel numbers PN4 are smaller than the column threshold (i.e., the determination result of the step S540 is "No"), the driving circuit 420 executes step S580. Herein the row threshold is set to be greater than or equal to a half of the column number (i.e., the number of the column electrodes) of the passive display panel 410, and the column threshold is set to be greater than or equal to a half of the row number (i.e., the number of the row electrodes) of the passive display panel 410.

In step S560, the driving circuit 420 displays the first color at each row or each column of pixels of the passive display panel 410. In the present embodiment, the driving circuit 420 calculates the number of pixel numbers PN4 that are greater than or equal to the column threshold as a column weight CW and the number of pixel numbers PN3 that are greater than or equal to the row threshold as a row weight RW. When the column weight CW is greater than the row weight RW and each pixel number PN4 is greater than or equal to the column threshold, the driving circuit 420 displays the first color at all the pixels in corresponding columns on the passive display panel 410. When the column weight CW is smaller than the row weight RW and each pixel number PN3 is greater than or equal to the row threshold, the driving circuit 420 displays the first color at all the pixels in corresponding rows on the passive display panel 410.

As described above, in the present embodiment, the driving circuit 420 selectively displays the first color at each row or each column of pixels of the passive display panel 410 according to the display frame. However, in other embodiments, when each pixel number PN3 is greater than or equal to the row threshold, the driving circuit 420 displays the first color at all the pixels in corresponding rows on the passive display panel 410, and when each pixel number PN4 is greater than or equal to the column threshold, the driving circuit 420 displays the first color at corresponding columns of pixels of the passive display panel 410. The driving circuit 420 executes step S580 after step S560.

In step S580, the driving circuit 420 displays the first color column by column or row by row at the pixels of the passive display panel 410 that are corresponding to the first color and do not display the first color. In the present embodiment, when the driving circuit 420 determines that the column number of the passive display panel 410 is greater than the row number of the passive display panel 410, the driving circuit 420 displays the first color column by column at the pixels of the passive display panel 410 that are corresponding to the first color and do not display the first color. When the driving circuit 420 determines that the column number of the passive display panel 410 is smaller than the row number of the passive display panel 410, the driving circuit 420 displays the first color row by row at the pixels of the passive display panel 410 that are corresponding to the first color and do not display the first color. When the driving circuit 420 determines that the column number of the passive display panel 410 is equal to the row number of the passive display panel 410, the driving circuit 420 displays the first color column by column or row by row at the pixels of the passive display panel 410 that are corresponding to the first color and do not display the first color.

In step S590, the driving circuit 420 displays the second color column by column or row by row at the pixels of the passive display panel 410 that are corresponding to the second color and do not display the second color. In the present embodiment, when the driving circuit 420 determines that the column number of the passive display panel 410 is greater than the row number of the passive display panel 410, the driving circuit 420 displays the second color column by column at the pixels of the passive display panel 410 that are corresponding to the second color and do not display the second color. When the driving circuit 420 determines that the column number of the passive display panel 410 is smaller than the row number of the passive display panel 410, the driving circuit 420 displays the second color row by row at the pixels of the passive display panel 410 that are corresponding to the second color and do not display the second color. When the driving circuit 420 determines that the column number of the passive display panel 410 is equal to the row number of the passive display panel 410, the driving circuit 420 displays the second color column by column or row by row at the pixels of the passive display panel 410 that are corresponding to the second color and do not display the second color.

Additionally, in steps S580 and S590, the driving circuit 420 displays the first color or the second color on the passive display panel 410 column by column or row by row. Herein the driving method adopted by the driving circuit 420 is similar to the conventional single-point driving method. Thus, the capacitive coupling effect is taken into consideration to further eliminate the impact thereof on the display effect of the passive display panel 410. In other words, a higher voltage level of the driving signal supplied by the driving circuit 420 results in a shorter time for driving the passive display panel 410 to display a gray scale (or color), a greater coupling voltage and a lower quality of the display frame. Thus, according to an embodiment of the invention, because the voltage level of the coupling voltage of each pixel is determined by the voltage level of the driving signal (for example, the driving signal S1) and the duration of the driving time, the driving circuit 420 can adjust the voltage level of the driving signal and the duration of the driving time to make the coupling voltage of each pixel smaller than the threshold voltage for driving the pixel, so that the pixels of the passive display panel 410 are not affected by their coupling voltages and do not produce any abnormal display effect.

Referring to step S510, if the pixel number PN1 is greater than or equal to the pixel number PN2, the driving circuit 420 executes step S530. In step S530, the driving circuit 420 displays the first color frame on the passive display panel 410 and then executes the step S550. In an embodiment of the invention, the driving circuit 420 calculates a plurality of pixel numbers PN5 (corresponding to fourth pixel numbers and row pixel numbers) respectively corresponding to the second color in a plurality of rows of display data of the display frame (i.e., counts the number of pixels corresponding to the second color in each row of display data). Besides, the driving circuit 420 calculates a plurality of pixel numbers PN6 (corresponding to sixth pixel numbers and column pixel numbers) respectively corresponding to the second color in a plurality of columns of display data of the display frame (i.e., counts the number of pixels corresponding to the second color in each column of display data).

When at least one of the pixel numbers PN5 is greater than or equal to the row threshold or at least one of the pixel numbers PN6 is greater than or equal to the column threshold (i.e., the determination result of the step S550 is "Yes"), the driving circuit 420 executes step S570. Contrarily, when all the pixel numbers PN5 are smaller than the row threshold and all the pixel numbers PN6 are smaller than the column threshold (i.e., the determination result of the step S550 is "No"), the driving circuit 420 executes step S580.

In step S570, the driving circuit 420 displays the second color at each row or each column of pixels of the passive display panel 410. In the present embodiment, the driving circuit 420 calculates the number of pixel numbers PN6 that are greater than or equal to the column threshold as a column weight CW and calculates the number of pixel numbers PN5 that are greater than or equal to the row threshold as a row weight RW. When the column weight CW is greater than the row weight RW and each pixel number PN6 is greater than or equal to the column threshold, the driving circuit 420 displays the second color at all the pixels in corresponding columns on the passive display panel 410. When the column weight CW is smaller than or equal to the row weight RW and each pixel number PN5 is greater than or equal to the row threshold, the driving circuit 420 displays the second color at all the pixels in corresponding rows on the passive display panel 410. The sequence of the steps in the embodiment described above is only adopted for describing the invention but not intended to limit the scope of the invention. In other words, in an embodiment of the invention, the step S590 may be executed before the step S580.

As described above, in the present embodiment, the driving circuit 420 selectively displays the second color at each row or each column of pixels of the passive display panel 410 according to the display frame. However, in other embodiments, when each pixel number PN5 is greater than or equal to the row threshold, the driving circuit 420 displays the second color at all the pixels in corresponding rows on the passive display panel 410, and when each pixel number PN6 is greater than or equal to the column threshold, the driving circuit 420 displays the second color at corresponding columns of pixels of the passive display panel 410. The driving circuit 420 executes step S580 after step S570.

As described above, in steps S540, S550, S560, and S570, each time the driving circuit 420 displays the first color or the second color at all the pixels in each column or each row on the passive display panel 410 so that the display quality of the passive display panel 410 won't be affected by the capacitive coupling effect. In steps S580 and S590, the driving circuit 420 displays the first color and the second color column by column or row by row based on the expressions 6.1 and 6.2 and with a smaller coupling voltage. Additionally, the speed of displaying a frame is increased by displaying the frame in unit of each entire column, each entire row, column by column, and row by row.

Figure 6:
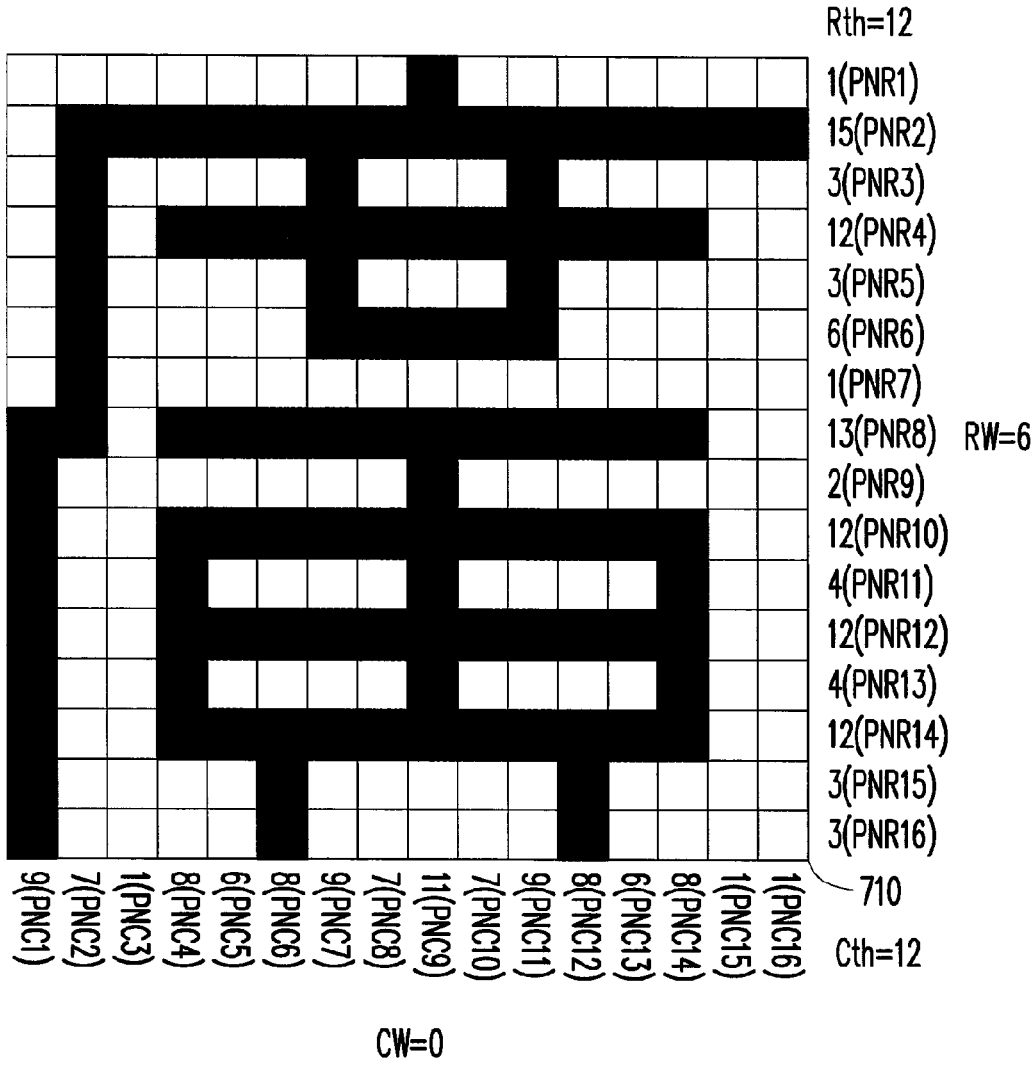
FIG. 6 is a diagram of a display frame according to an embodiment of the invention.

FIG. 6 is a diagram of a display frame according to an embodiment of the invention. Referring to FIG. 6, in the present embodiment, it is assumed that the display frame is a black and white display frame containing a Chinese character "廣" and is a 16×16 frame. FIGS. 7A-7D are diagrams illustrating the display procedure of a display frame according to an embodiment of the invention. Referring to FIGS. 7A-7D, in the present embodiment, for the convenience of description, the size of the pixel array of the passive display panel 710 is set to 16×16 according to the size of the display frame. Namely, each display data of the display frame is corresponding to a pixel of the passive display panel 710, and the driven pixels are denoted with slash.

Figure 7A:
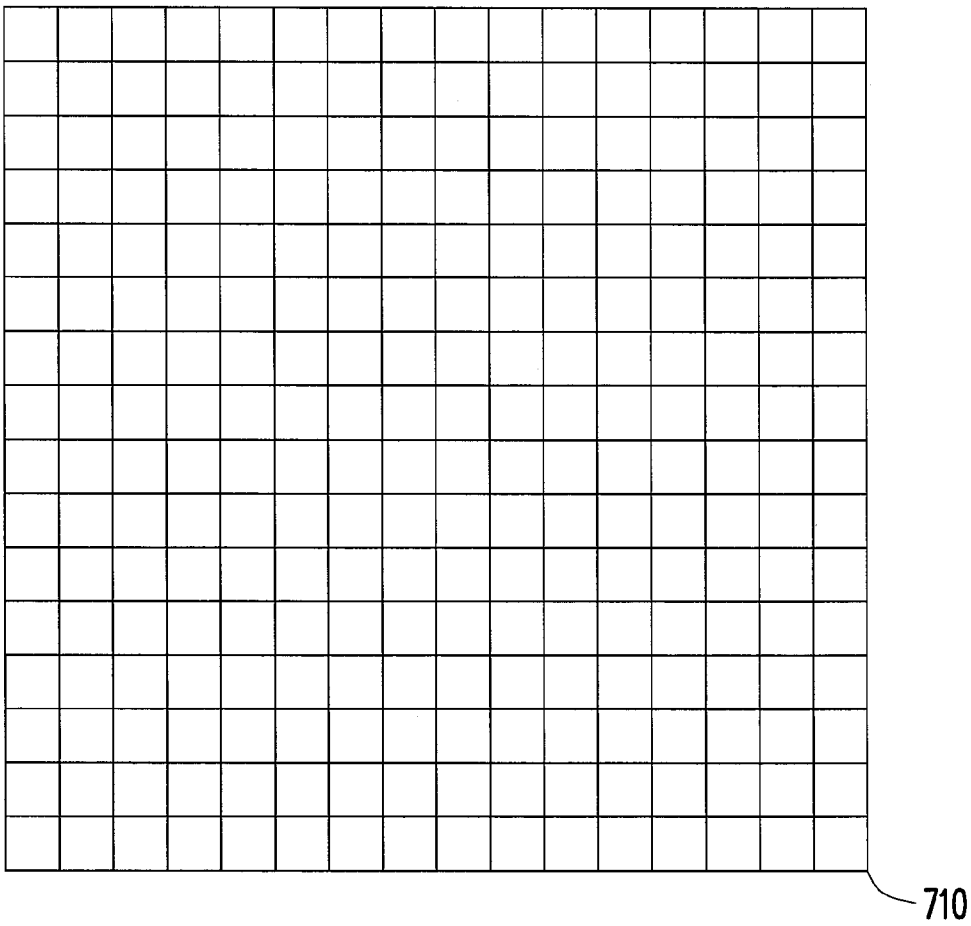
FIGS. 7A-7D are diagrams illustrating the display procedure of a display frame according to an embodiment of the invention.

Referring to FIG. 6 and FIG. 7A, in the present embodiment, there are 106 black (corresponding to the first color) display data (corresponding to the number of black pixels) and 150 white (corresponding to the second color) display data (corresponding to the number of white pixels) in the display frame (as shown in FIG. 6). Thus, a white frame (corresponding to the second color frame) is first displayed on the passive display panel 710 (i.e., white is displayed at all the pixels of the passive display panel 710).

Figure 7B:
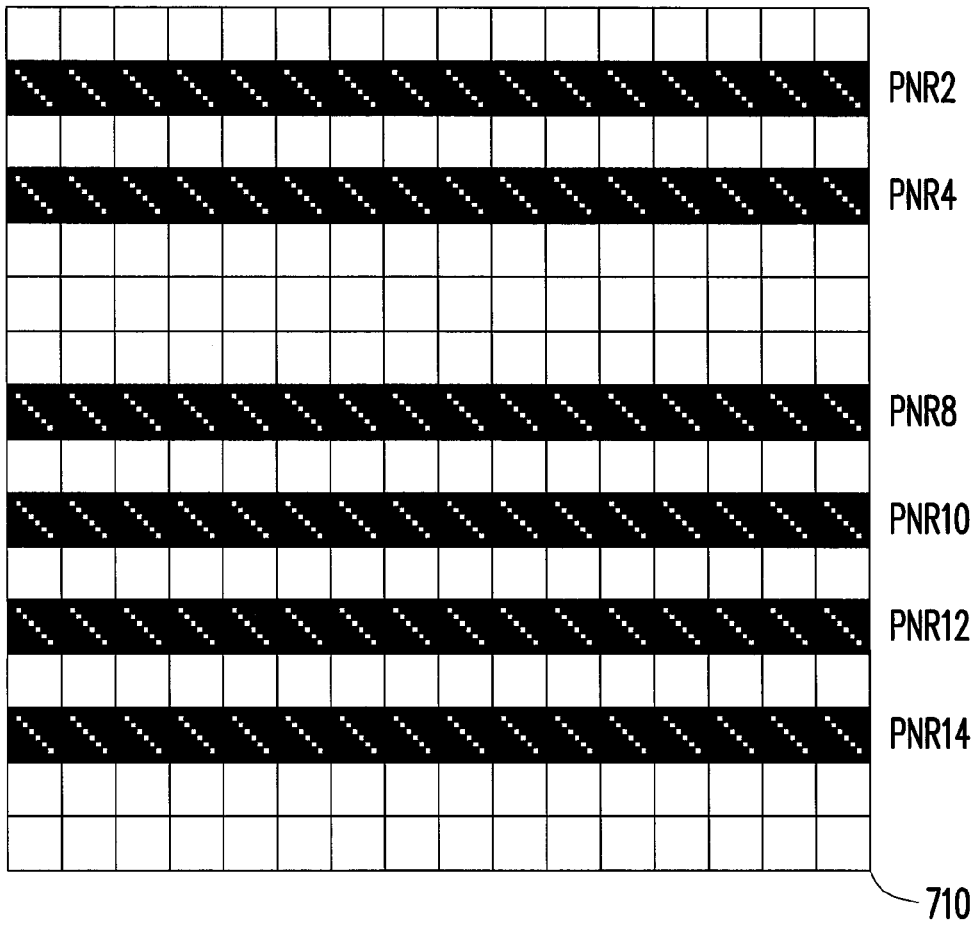

Then, referring to FIG. 6 and FIG. 7B, the number (for example, PNC1-PNC16) of black pixels in each column of display data of the display frame and the number (for example, PNR1-PNR16) of black pixels in each row of display data of the display frame can be counted by referring to FIG. 6. In the present embodiment, the column threshold Cth is set to 12 (i.e., ¾ of the row number), and the row threshold Rth is set to 12 (i.e., ¾ of the column number). Herein none of the numbers PNC1-PNC16 corresponding to each column of display data is greater than or equal to the column threshold Cth (i.e., the column weight CW is 0), and 6 of the numbers PNR1-PNR16 corresponding to each row of display data are greater than or equal to the row threshold Rth (i.e., the row weight RW is 6).

Since the row weight RW is greater than the column weight CW, the display frame is displayed on the passive display panel 710 in unit of each entire row. Besides, because the pixel numbers PNR2, PNR4, PNR8, PNR10, PNR12, and PNR14 are greater than or equal to the row threshold Rth, all the pixels in the rows corresponding to the pixel numbers PNR2, PNR4, PNR8, PNR10, PNR12, and PNR14 display the black.

Figure 7C:
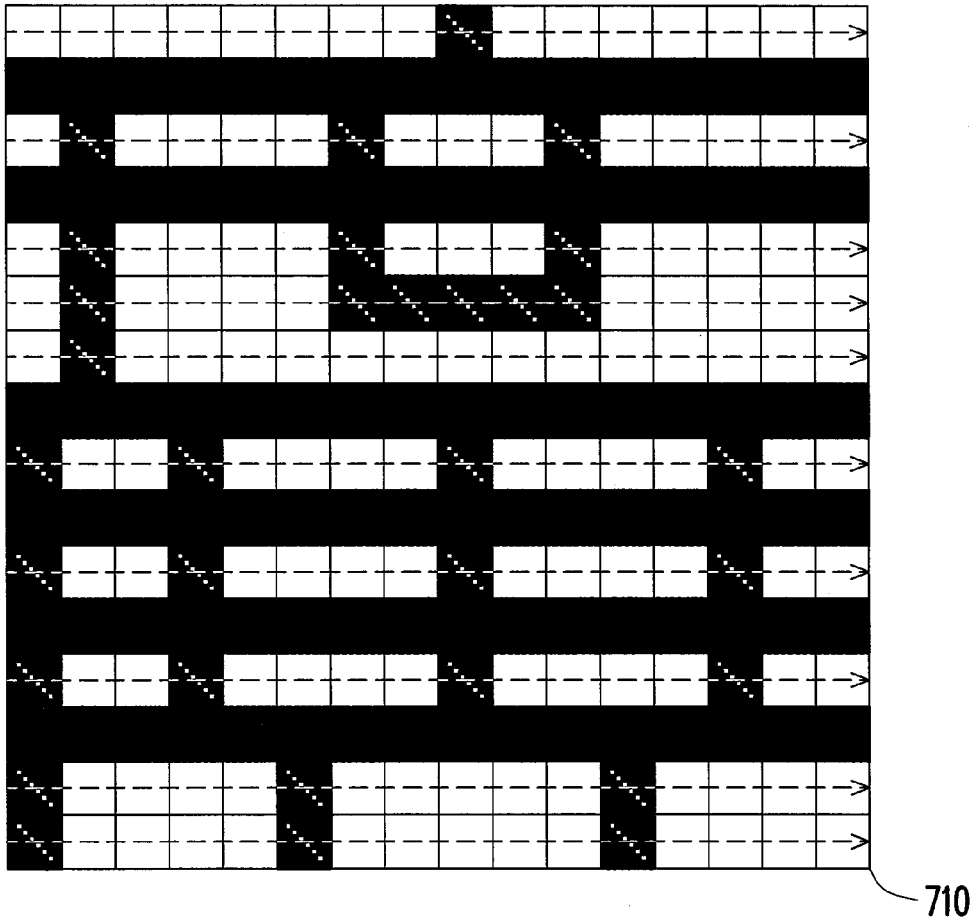

Referring to FIG. 6 and FIG. 7C, because the column number (16 in the present embodiment) of the passive display panel 710 is equal to the row number (16 in the present embodiment) thereof, the black is displayed column by column or row by row at the pixels in each column or each row of the passive display panel 710 that should display the black but do not display the black. In the present embodiment, the black is displayed row by row at the pixels in each row of the passive display panel 710 that should display the black but do not display the black.

Figure 7D:
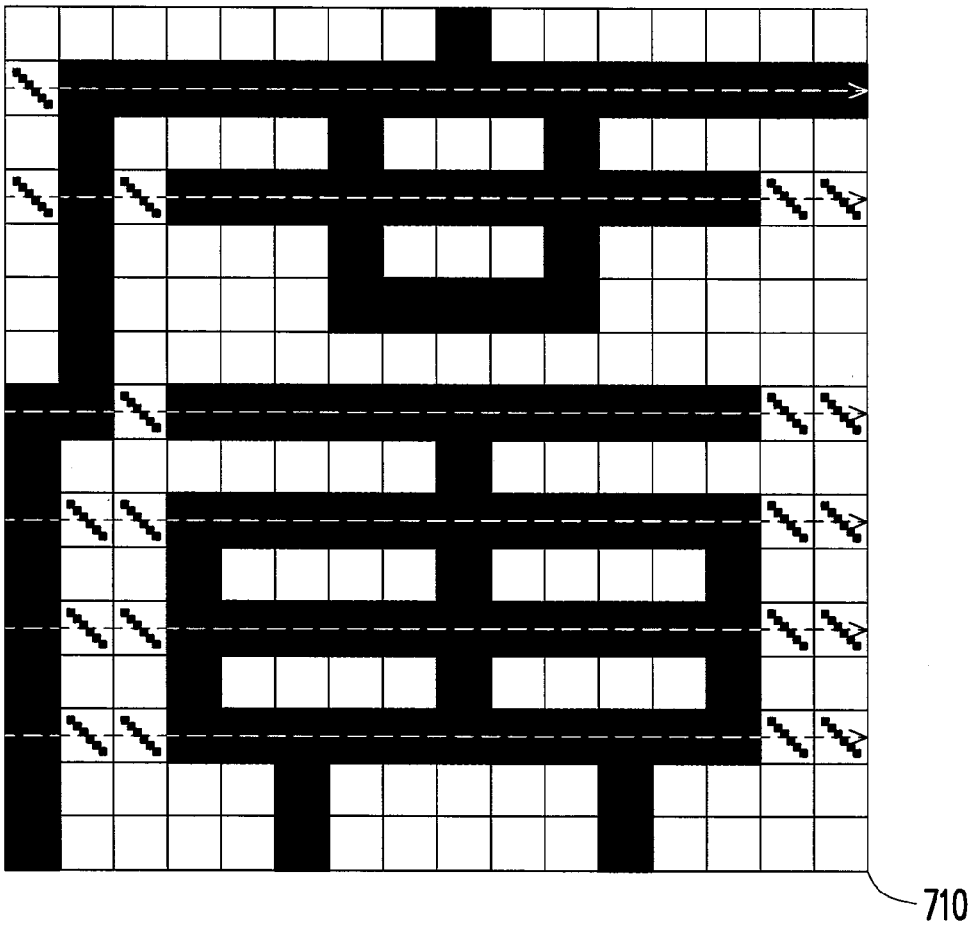

Referring to FIG. 6 and FIG. 7D, since the column number of the passive display panel 710 is equal to the row number thereof, the white is displayed column by column or row by row at the pixels in each column or each row of the passive display panel 710 that should but do not display the white. In the present embodiment, the white is displayed row by row at the pixels in each row of the passive display panel 710 that should display the white but do not display the white.

As described above, in a driving method of a passive display panel and a display apparatus provided by embodiments of the invention, whether to display a first color or a second color at each column or each row of pixels of the passive display panel is determined, and then the first color or the second color is displayed column by column or row by row at parts of the pixels corresponding to the first color or the second color. By displaying the first color or the second color at entire column or entire row of pixels, the production of capacitive coupling effect is avoided and accordingly the impact of capacitive coupling effect on the display quality of the passive display panel is avoided or reduced. Moreover, the speed for displaying a frame is increased by displaying the frame in unit of each entire column, each entire row, column by column, and row by row.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. A driving method of a passive display panel, wherein the passive display panel comprises a plurality of pixels arranged into an array, the driving method comprising:

determining whether to display a first color frame or a second color frame on the passive display panel according to a display frame;

after the second color frame is displayed on the passive display panel, determining whether to display a first color at each row of the pixels of the passive display panel according to the display frame, and determining whether to display the first color at each column of the pixels of the passive display panel according to the display frame;

after the first color frame is displayed on the passive display panel, determining whether to display a second color at each row of the pixels of the passive display panel according to the display frame, and determining whether to display the second color at each column of the pixels of the passive display panel according to the display frame;

displaying the first color column by column or row by row at the pixels of the passive display panel that are corresponding to the first color and do not display the first color; and displaying the second color column by column or row by row at the pixels of the passive display panel that are corresponding to the second color and do not display the second color, wherein the step of displaying the first color row by row or column by column at the pixels of the passive display panel that are corresponding to the first color and do not display the first color comprises:

when a column number of the passive display panel is greater than a row number of the passive display panel, displaying the first color column by column at the pixels of the passive display panel that are corresponding to the first color and do not display the first color;

when the column number of the passive display panel is smaller than the row number of the passive display panel, displaying the first color row by row at the pixels of the passive display panel that are corresponding to the first color and do not display the first color; and when the column number of the passive display panel is equal to the row number of the passive display panel, displaying the first color column by column or row by row at the pixels of the passive display panel that are corresponding to the first color and do not display the first color.

2. The driving method according to claim 1, wherein the step of determining whether to display the first color frame or the second color frame on the passive display panel according to the display frame comprises:

calculating a first pixel number corresponding to the first color and a second pixel number corresponding to the second color in the display frame;

when the first pixel number is greater than or equal to the second pixel number, displaying the first color frame on the passive display panel; and when the first pixel number is smaller than the second pixel number, displaying the second color frame on the passive display panel.

3. The driving method according to claim 1, wherein the step of determining whether to display the first color at each row of the pixels of the passive display panel according to the display frame comprises:

calculating a plurality of third pixel numbers respectively corresponding to the first color in a plurality of rows of display data of the display frame; and when each of the third pixel numbers is greater than or equal to a row threshold, displaying the first color at corresponding rows of the pixels of the passive display panel.

4. The driving method according to claim 3, wherein the step of determining whether to display the second color at each row of the pixels of the passive display panel according to the display frame comprises:

calculating a plurality of fourth pixel numbers respectively corresponding to the second color in a plurality of rows of display data of the display frame; and when each of the fourth pixel numbers is greater than or equal to the row threshold, displaying the second color at corresponding rows of the pixels of the passive display panel.

5. The driving method according to claim 3, wherein the row threshold is greater than or equal to a half of a column number of the passive display panel.

6. The driving method according to claim 1, wherein the step of determining whether to display the first color at each column of the pixels of the passive display panel according to the display frame comprises:

calculating a plurality of fifth pixel numbers respectively corresponding to the first color in a plurality of columns of display data of the display frame; and when each of the fifth pixel numbers is greater than or equal to a column threshold, displaying the first color at corresponding columns of the pixels of the passive display panel.

7. The driving method according to claim 6, wherein the step of determining whether to display the second color at each column of the pixels of the passive display panel according to the display frame comprises:

calculating a plurality of sixth pixel numbers respectively corresponding to the second color in a plurality of columns of display data of the display frame; and when each of the sixth pixel numbers is greater than or equal to the column threshold, displaying the second color at corresponding columns of the pixels of the passive display panel.

8. The driving method according to claim 6, wherein the column threshold is greater than or equal to a half of a row number of the passive display panel.

9. The driving method according to claim 1, wherein the step of displaying the second color column by column or row by row at the pixels of the passive display panel that are corresponding to the second color and do not display the second color comprises:

when a column number of the passive display panel is greater than a row number of the passive display panel, displaying the second color column by column at the pixels of the passive display panel that are corresponding to the second color and do not display the second color;

when the column number of the passive display panel is smaller than the row number of the passive display panel, displaying the second color row by row at the pixels of the passive display panel that are corresponding to the second color and do not display the second color; and when the column number of the passive display panel is equal to the row number of the passive display panel, displaying the second color column by column or row by row at the pixels of the passive display panel that are corresponding to the second color and do not display the second color.

10. The driving method according to claim 1, wherein the first color and the second color are respectively white and black.

11. The driving method according to claim 1, wherein the step of determining whether to display the first color at each row of the pixels of the passive display panel according to the display frame and determining whether to display the first color at each column of the pixels of the passive display panel according to the display frame comprises:

calculating a plurality of column pixel numbers respectively corresponding to the first color in a plurality of columns of display data of the display frame;

calculating a number of the column pixel numbers that are greater than or equal to a column threshold as a column weight;

calculating a plurality of row pixel numbers respectively corresponding to the first color in a plurality of rows of display data of the display frame;

calculating a number of the row pixel numbers that are greater than or equal to a row threshold as a row weight;

when the column weight is greater than the row weight and each of the column pixel numbers is greater than or equal to the column threshold, displaying the first color at corresponding columns of the pixels of the passive display panel; and when the column weight is smaller than or equal to the row weight and each of the row pixel numbers is greater than or equal to the row threshold, displaying the first color at corresponding rows of the pixels of the passive display panel.

12. The driving method according to claim 1, wherein the step of determining whether to display the second color at each row of the pixels of the passive display panel according to the display frame and determining whether to display the second color at each column of the pixels of the passive display panel according to the display frame comprises:

calculating a plurality of column pixel numbers respectively corresponding to the second color in a plurality of columns of display data of the display frame;

calculating a number of the column pixel numbers that are greater than or equal to a column threshold as a column weight;

calculating a plurality of row pixel numbers respectively corresponding to the second color in a plurality of columns of display data of the display frame;

calculating a number of the row pixel numbers that are greater than or equal to a row threshold as a row weight;

when the column weight is greater than the row weight and each of the column pixel numbers is greater than or equal to the column threshold, displaying the second color at corresponding columns of the pixels of the passive display panel; and when the column weight is smaller than or equal to the row weight and each of the row pixel numbers is greater than or equal to the row threshold, displaying the second color at corresponding rows of the pixels of the passive display panel.

13. A display apparatus, comprising:

a passive display panel, comprising a plurality of pixels arranged into an array;

a driving circuit, coupled to the passive display panel, wherein the driving circuit determines whether to display a first color frame or a second color frame on the passive display panel according to a display frame, after displaying the second color frame on the passive display panel, the driving circuit determines whether to display a first color at each row of the pixels of the passive display panel according to the display frame and determines whether to display the first color at each column of the pixels of the passive display panel according to the display frame, after displaying the first color frame on the passive display panel, the driving circuit determines whether to display a second color at each row of the pixels of the passive display panel according to the display frame and determines whether to display the second color at each column of the pixels of the passive display panel according to the display frame, and the driving circuit displays the first color column by column or row by row at the pixels of the passive display panel that are corresponding to the first color and do not display the first color and displays the second color column by column or row by row at the pixels of the passive display panel that are corresponding to the second color and do not display the second color, wherein when a column number of the passive display panel is greater than a row number of the passive display panel, the driving circuit displays the first color column by column at the pixels of the passive display panel that are corresponding to the first color and do not display the first color, when the column number of the passive display panel is smaller than the row number of the passive display panel, the driving circuit displays the first color row by row at the pixels of the passive display panel that are corresponding to the first color and do not display the first color, and when the column number of the passive display panel is equal to the row number of the passive display panel, the driving circuit displays the first color column by column or row by row at the pixels of the passive display panel that are corresponding to the first color and do not display the first color.

14. The display apparatus according to claim 13, wherein the driving circuit calculates a first pixel number corresponding to the first color and a second pixel number corresponding to the second color in the display frame, when the first pixel number is greater than or equal to the second pixel number, the driving circuit displays the first color frame on the passive display panel, and when the first pixel number is smaller than the second pixel number, the driving circuit displays the second color frame on the passive display panel.

15. The display apparatus according to claim 13, wherein the driving circuit calculates a plurality of third pixel numbers respectively corresponding to the first color in a plurality of rows of display data of the display frame, and when each of the third pixel numbers is greater than or equal to a row threshold, the driving circuit displays the first color at corresponding rows of the pixels of the passive display panel.

16. The display apparatus according to claim 15, wherein the driving circuit calculates a plurality of fourth pixel numbers respectively corresponding to the second color in a plurality of rows of display data of the display frame, and when each of the fourth pixel numbers is greater than or equal to the row threshold, the driving circuit displays the second color at corresponding rows of the pixels of the passive display panel.

17. The display apparatus according to claim 15, wherein the row threshold is greater than or equal to a half of a column number of the passive display panel.

18. The display apparatus according to claim 13, wherein the driving circuit calculates a plurality of fifth pixel numbers respectively corresponding to the first color in a plurality of columns of display data of the display frame, and when each of the fifth pixel numbers is greater than or equal to a column threshold, the driving circuit displays the first color at corresponding columns of the pixels of the passive display panel.

19. The display apparatus according to claim 18, wherein the driving circuit calculates a plurality of sixth pixel numbers respectively corresponding to the second color in a plurality of columns of display data of the display frame, and when each of the sixth pixel numbers is greater than or equal to the column threshold, the driving circuit displays the second color at corresponding columns of the pixels of the passive display panel.

20. The display apparatus according to claim 18, wherein the column threshold is greater than or equal to a half of a row number of the passive display panel.

21. The display apparatus according to claim 13, wherein when a column number of the passive display panel is greater than a row number of the passive display panel, the driving circuit displays the second color column by column at the pixels of the passive display panel that are corresponding to the second color and do not display the second color, when the column number of the passive display panel is smaller than the row number of the passive display panel, the driving circuit displays the second color row by row at the pixels of the passive display panel that are corresponding to the second color and do not display the second color, and when the column number of the passive display panel is equal to the row number of the passive display panel, the driving circuit displays the second color column by column or row by row at the pixels of the passive display panel that are corresponding to the second color and do not display the second color.

22. The display apparatus according to claim 13, wherein the first color and the second color are respectively white and black.

23. The display apparatus according to claim 13, wherein the passive display panel is an electronic paper display panel.

24. The display apparatus according to claim 13, wherein the driving circuit calculates a plurality of column pixel numbers respectively corresponding to the first color in a plurality of columns of display data of the display frame, calculates a number of the column pixel numbers that are greater than or equal to a column threshold as a column weight, calculates a plurality of row pixel numbers respectively corresponding to the first color in a plurality of rows of display data of the display frame, and calculates a number of the row pixel numbers that are greater than or equal to a row threshold as a row weight, when the column weight is greater than the row weight and each of the column pixel numbers is greater than or equal to the column threshold, the driving circuit displays the first color at corresponding columns of the pixels of the passive display panel, and when the column weight is smaller than or equal to the row weight and each of the row pixel numbers is greater than or equal to the row threshold, the driving circuit displays the first color at corresponding rows of the pixels of the passive display panel.

25. The display apparatus according to claim 13, wherein the driving circuit calculates a plurality of column pixel numbers respectively corresponding to the second color in a plurality of columns of display data of the display frame, calculates a number of the column pixel numbers that are greater than or equal to a column threshold as a column weight, calculates a plurality of row pixel numbers respectively corresponding to the second color in a plurality of columns of display data of the display frame, and calculates a number of the row pixel numbers that are greater than or equal to a row threshold as a row weight, when the column weight is greater than the row weight and each of the column pixel numbers is greater than or equal to the column threshold, the driving circuit displays the second color at corresponding columns of the pixels of the passive display panel, and when the column weight is smaller than or equal to the row weight and each of the row pixel numbers is greater than or equal to the row threshold, the driving circuit displays the second color at corresponding rows of the pixels of the passive display panel.

* * * * *